US009375589B1

(12) United States Patent
Goodman

(10) Patent No.: US 9,375,589 B1
(45) Date of Patent: Jun. 28, 2016

(54) SAFETY GLASS BREAKER

(71) Applicant: Larry Goodman, Cerritos, CA (US)

(72) Inventor: Larry Goodman, Cerritos, CA (US)

( * ) Notice: Subject to any disclaimer, the term of this patent is extended or adjusted under 35 U.S.C. 154(b) by 0 days.

(21) Appl. No.: 14/725,511

(22) Filed: May 29, 2015

(51) Int. Cl.
*A62B 3/00* (2006.01)

(52) U.S. Cl.
CPC ..... *A62B 3/005* (2013.01); *Y10S 30/04* (2013.01); *Y10T 225/371* (2015.04)

(58) Field of Classification Search
CPC ..... A62B 3/005; Y10S 30/04; Y10S 60/914; Y10T 83/8863; Y10T 225/371; Y10T 29/53839; B21D 28/007; B25B 27/0085; B25B 21/023
USPC ..... 30/367, 277, DIG. 4, 164.6; 227/10; 604/69; 42/70.08; 225/103; 102/502
See application file for complete search history.

(56) References Cited

U.S. PATENT DOCUMENTS 1,663,834 A * 3/1928 Goss ..... F41H 9/10 42/1.08
1,897,992 A * 2/1933 Ailes ..... F41B 15/02 42/1.08
3,074,165 A * 1/1963 Davis ..... B21D 28/007 30/358
3,315,397 A * 4/1967 Gilliam ..... F41A 19/40 124/80
3,956,843 A * 5/1976 Litman ..... F41C 27/06 42/1.08
4,757,628 A * 7/1988 Bulfer ..... F41C 9/06 42/1.14
5,062,230 A * 11/1991 Braverman ..... F41C 9/02 42/1.09
6,418,628 B1 7/2002 Steingass
7,557,720 B2 7/2009 Rubin et al.
8,727,060 B1 * 5/2014 Erickson ..... B60R 21/00 180/271
2004/0050607 A1 * 3/2004 Souther ..... A62B 3/005 180/271
2010/0317247 A1 * 12/2010 McGlynn ..... A62B 3/005 441/80
2013/0227795 A1 9/2013 Franken
2015/0033477 A1 2/2015 Rubin et al.

* cited by examiner

*Primary Examiner* — Laura M Lee
(74) *Attorney, Agent, or Firm* — Kenneth L. Green; Averill & Green

(57) ABSTRACT

An automobile safety glass breaker tool is held against an automobile safety glass window and fired to break the window. The tool is armed by sliding a firing pin piston to the rear against a spring and fired by releasing the firing pin piston. The firing pin piston hits a 22 blank cartridge to fire the blank cartridge. The blank cartridge drives a striker piston forward, and a striker point on the striker piston impacts and shatters the automobile safety glass window. The striker point is limited to reach about 0.6 inches forward and out of the tool to prevent injury to a user.

20 Claims, 2 Drawing Sheets

SAFETY GLASS BREAKER

BACKGROUND OF THE INVENTION

The present invention relates to controlled breaking of glass and in particular to a tool for breaking automobile windows.

Automobiles involved in traffic accidents often are damaged to the extent that the occupants cannot easily escape the automobile. When there is a fire or risk of a fire, or the automobile is submerged or becoming submerged, or there is a risk of the automobile sliding down a slope, a rapid escape by the occupants is very important.

Various tools are known for breaking automobile window glass to allow escape. U.S. Pat. No. 6,418,628 issued Jul. 16, 2002 discloses a spring actuated tool for fire fighters and emergency personnel for breaking automobile glass. Unfortunately, such spring actuated tools do not always break the glass, and over time, the springs may weaken. Other similar tools do not always provide the necessary result.

BRIEF SUMMARY OF THE INVENTION

The present invention addresses the above and other needs by providing an automobile safety glass breaker tool which is held against an automobile safety glass window and fired to break the window. The tool is armed by sliding a firing pin piston to the rear against a spring and fired by releasing the firing pin piston. The firing pin piston hits a .22 blank cartridge to fire the blank cartridge. The blank cartridge drives a striker piston forward, and a striker point on the striker piston impacts and shatters the automobile safety glass window. The striker point is limited to reach about 0.6 inches forward and out of the tool to prevent injury to a user.

In accordance with one aspect of the invention, there is provided a .22 blank cartridge actuated automobile safety glass breaker tool. Known tools are spring actuated and limited by the impact force of the spring. The springs often do not provide a sufficient impact to shatter automobile safety glass.

In accordance with another aspect of the invention, there is provided a very short travel automobile safety glass breaker tool. The expanding gasses provided by the 22 blank cartridge drives the point quickly and firmly against the glass. A preferred travel of 0.060 inches reduces or eliminates the possibility of injury should the tool be fired against a human.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
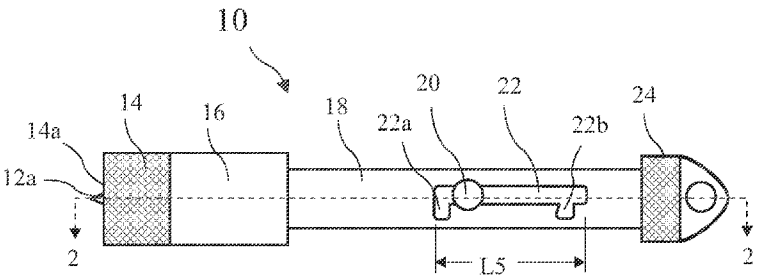
FIG. 1 is a side view of an automobile safety glass breaker tool according to the present invention.

A side view of an automobile safety glass breaker tool 10 according to the present invention is shown in FIG. 1. The tool 10 includes a striker tip 12*a* of a striker 12, a striker housing cap 14 having a forward face 14*a* of the safety glass breaker tool, a striker housing 16, a firing pin piston housing 18 providing a handle for the tool 10, a trigger 20, a longitudinally extending trigger slot 22, and a trigger housing cap 24. The trigger slot 22 includes a first angular recess 22*a* at an end nearest to the striker 12, and a second angular recess 22*b* farthest from the striker 12. The second angular recess 22*b* is sloped axially towards the striker 12 providing a cocked position for the trigger 20. The trigger slot 22 has an overall length L5 of preferably 0.9 inches. Elements for the tool 10 are generally cylindrical with a round cross-section, except for the trigger 20, the trigger slot 22, and the firing pin 29.

Figure 2:
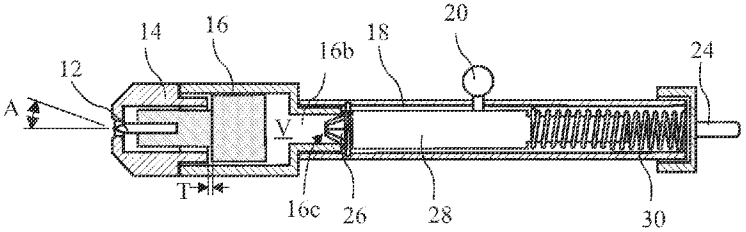
FIG. 2 is a cross-sectional view of the automobile safety glass breaker tool according to the present invention taken along line 2-2 of FIG. 1.
Figure 3:
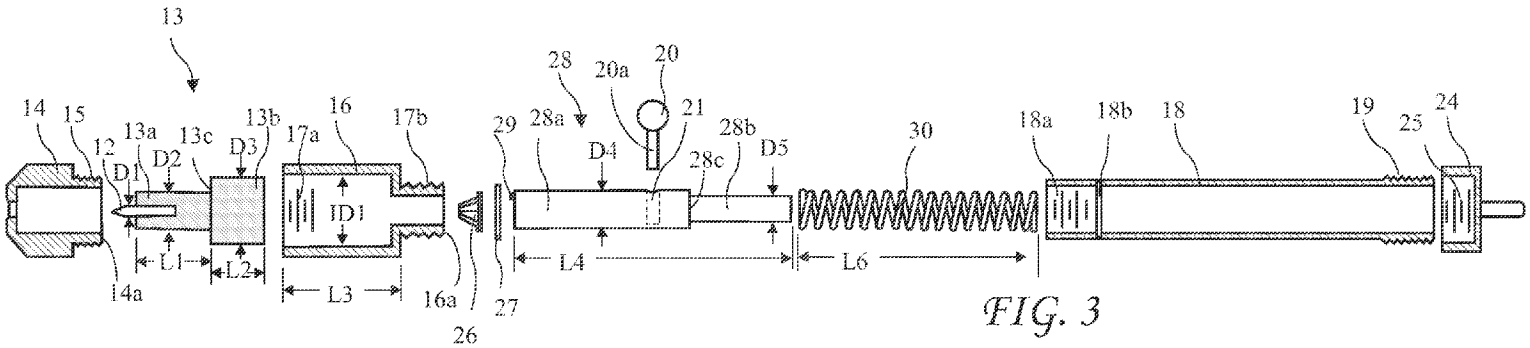
FIG. 3 is an exploded cross-sectional view of the automobile safety glass breaker tool according to the present invention taken along line 2-2 of FIG. 1.

A cross-sectional view of the tool 10 taken along line 2-2 of FIG. 1 is shown in FIG. 2 and an exploded cross-sectional view of the tool 10 taken along line 2-2 of FIG. 1 is shown in FIG. 3. The striker 12 is attached to a striker piston 13 including a first diameter cylindrical portion 13*a* and a second diameter cylindrical portion 13*b*, separated by a step 13*c*. The first cylindrical portion 13*a* has a length L1 of preferably 0.6 inches and a diameter D2 of preferably 0.25 inches. The second cylindrical portion 13*b* has a length L2 of preferably 0.4 inches and a diameter D3 of preferably 0.38 inches. The striker 12 is preferably a very hard material, for example, tungsten carbide or the like, and is preferably embedded in the striker piston 13 and has a diameter D1 of preferably ⅛ inches and a half angle A preferably between 30 degrees and 45 degrees, and more preferably 45 degrees. The second cylindrical portion 13*b* sides inside the striker housing 16 having an inside diameter ID1 of preferably 0.385 inches. The striker piston 13 is preferably an oil impregnated bronze material (e.g., oilite) or the like providing smooth sliding in the striker housing 16.

The striker housing cap 14 includes male threads 15 engaging female threads 17*a* in the striker housing 16. The striker housing cap 14 includes a striker stop surface 14*a* facing the step 13*c* and limiting reach of the striker 12 out of the glass breaker tool 10 to a travel T of preferably between 0.04 inches and 0.1 inches, and more preferably between 0.04 inched and 0.08 inches, and most preferably 0.06 inches. In general, the travel T is not more than 0.06 inches to avoid possible injury to a user.

The striker housing 16 further includes a rear reaching male threaded portion 17*b* threading into female threads 18*a* of the firing pin piston housing 18. The threaded portion 17*b* and 18*a* are preferably a ⅜ inch thread. The firing pin piston housing 18 includes a clip 27 residing in a groove 18*b* recessed past the threads 18*a*. When the piston housing is fully threaded onto the threaded portion 17*b*, the clip 27 holds a blank cartridge 26 residing in a blank cartridge position 26*c* against a rear facing blank cartridge stop surface 16*a* of the striker housing 16. The blank cartridge 26 is preferably a 22 blank cartridge, for example, a WALTHER 6 mm Flobert blank cartridge. Alternatively, a step may be formed in the firing pin piston housing 18 to sandwich the blank cartridge 26. The striker piston housing 16 and blank cartridge 26 form a closed striker housing chamber 16*b* for capturing pressure created by firing the blank cartridge 26 to drive the striker piston 13 forward. The striker housing chamber 16*b* has a volume V of preferably between 0.16 cubic inches and 0.04 cubic inches, and preferably 0.08 cubic inches. The clip 27 may be replaced by an internal forward facing step in the piston housing 18.

A piston 28 slides in the firing pin piston housing 18. The piston 18 includes the fixed firing pin 29 on a front facing surface for firing the blank cartridge 26. The blank cartridge 26 is preferably a rim fire blank cartridge and the pin 29 is offset. Alternatively, a centerfire blank cartridge may be used with a centered pin. The piston 28 has a length L4 of preferably 1.5 inches and includes a front portion 28*a* having a diameter D4 of preferably 0.312 inches and a rear portion 28*b* having a diameter D5 of preferably 0.215 inches. A step 28*c* separates the portions 28*a* and 28*b*. A spring 30 resided over the rear portion 28*b* and is held between the step 28*c* and the trigger housing cap 24 providing forward force on the piston 28. The spring 30 preferably has a spring rate between four and twelve pounds per inch, and more preferably eight pounds per inch, and has a free length L6 of preferably between 1.5 and 2.5 inches and more preferably two inches. The trigger 20 includes a shaft 20*a* engaging a hole 21 in the piston 28. The shaft 20*a* passes through the firing pin piston housing 18 allowing actuation of the trigger 20 to cock the tool 10 and to fire the tool 10. The trigger housing cap 24 includes female threads 25 engaging male threads 19 on the firing pin piston housing 18.

Figure 4:
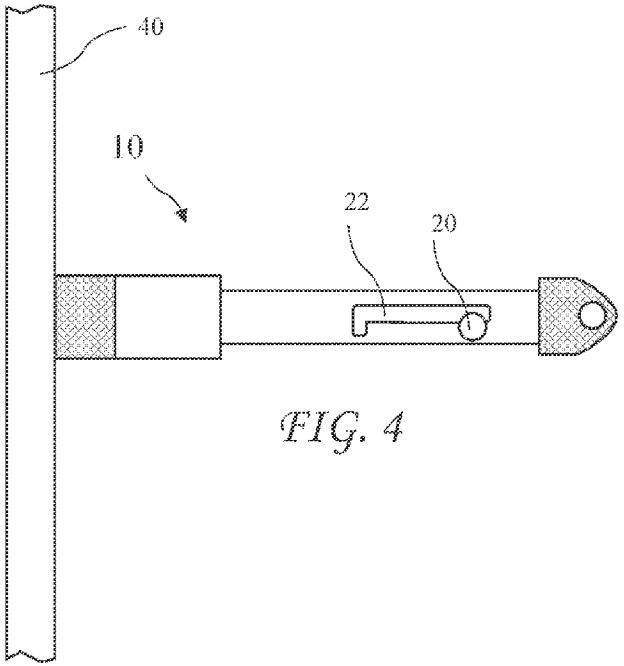
FIG. 4 shows the automobile safety glass breaker tool according to the present invention pressed against a safety glass window ready for use.
Figure 4A:
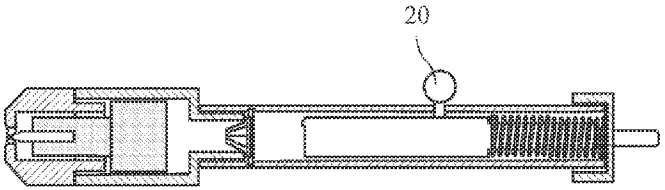
FIG. 4A shows a cross-sectional view of the automobile safety glass breaker tool according to the present invention ready for use.

FIG. 4 shows the tool 10 pressed against a safety glass window 40 ready for use and FIG. 4A shows a cross-sectional view of the tool 10 ready for use. The trigger 20 is drawn to the rear of the slot 22 and may be caught in the second recess 22*b* or held to the rear.

Figure 5:
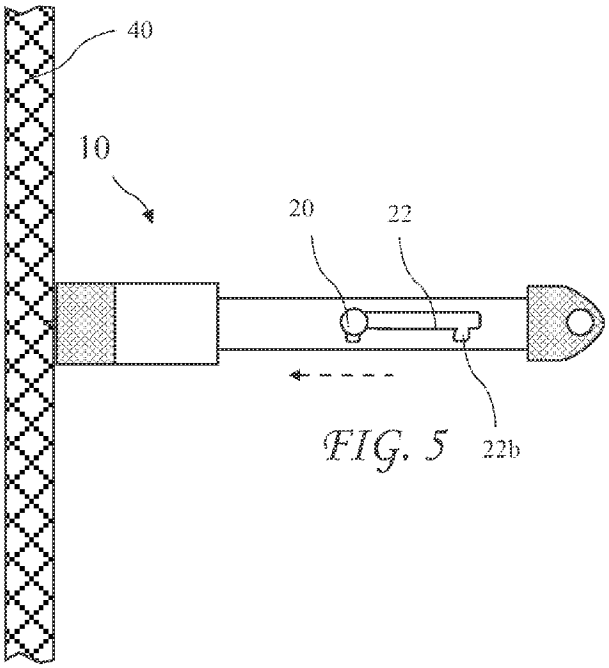
FIG. 5 shows the automobile safety glass breaker tool according to the present invention pressed against a shattered safety glass window after use.
Figure 5A:
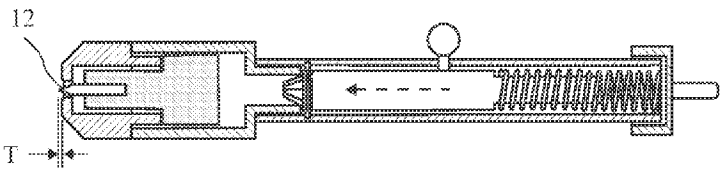
FIG. 5A shows a cross-sectional view of the automobile safety glass breaker tool according to the present invention after use.

FIG. 5 shows the tool 10 pressed against a shattered safety glass window 40 after use and FIG. 5A shows a cross-sectional view of the tool 10 after use. The striker 12 is limited to the travel T to prevent injury to a user.

While the invention herein disclosed has been described by means of specific embodiments and applications thereof, numerous modifications and variations could be made thereto by those skilled in the art without departing from the scope of the invention set forth in the claims.

I claim:

1. A window breaking tool, comprising:

a striker piston housing;

a handle extending back from the striker piston housing;

a striker piston sliding in the striker piston housing;

a striker extending forward from the striker piston;

a tip on a forward end of the striker, the striker piston limited to between 0.04 and 0.1 inches of forward travel by contact of a forward facing step of the striker piston with a striker stop surface, when the tip of the striker is even with a forward face of the window breaking tool;

a blank cartridge stop configured to position a blank cartridge in a blank cartridge position between the striker piston housing and the handle, positioning the blank cartridge to face the striker piston;

a striker housing chamber between the blank cartridge position and the striker piston, the striker housing closed by positioning the blank cartridge in the blank cartridge position; and a firing pin configured to strike the blank cartridge to fire the blank cartridge to create pressure in the striker housing chamber to propel the striker piston carrying the striker forward.

2. The tool of claim 1, wherein the striker piston is limited to 0.060 inches of forward travel by contact of said forward facing step of the striker piston with said striker stop surface, when the tip of the striker is even with the forward face of the window breaking tool.

3. The tool of claim 1, wherein the striker piston is limited to not more than 0.060 inches of forward travel by contact of said forward facing step of the striker piston with said striker stop surface, when the tip of a striker is even with the forward face of the window breaking tool.

4. The tool of claim 1, wherein the handle is a firing pin piston housing, the tool further including:

a firing pin piston sliding axially in the firing pin piston housing;

the firing pin comprising a fixed firing pin on a forward face of the firing pin piston aligned to fire the blank cartridge;

a trigger attached to the firing pin piston and extending out through a longitudinal slot in the firing pin piston housing; and a spring applying forward force against the firing pin piston towards the blank cartridge position.

5. The tool of claim 4, wherein the spring has free length between 1.5 and 2.5 inches and a spring rate between four and twelve pounds per inch.

6. The tool of claim 4, wherein the blank cartridge is a rim fire blank cartridge and the fixed firing pin is an offset fixed firing pin.

7. The tool of claim 4, wherein the longitudinal slot includes an angular recess at an end of the longitudinal slot farthest from the blank cartridge position.

8. The tool of claim 7, wherein the angular recess extends angularly around the firing pin piston housing and axially towards the blank cartridge position.

9. The tool of claim 1, wherein the striker has a pointed tip, the pointed tip having a half angle between 30 and 45 degree.

10. The tool of claim 9, wherein the striker has a pointed tip, the pointed tip having a half angle of 45 degree.

11. The tool of claim 9, wherein the striker housing chamber has a volume of 0.08 cubic inches.

12. The tool of claim 1, wherein the striker housing chamber has a volume of between 0.16 cubic inches and 0.04 cubic inches.

13. The tool of claim 1, wherein the striker is made from tungsten carbide.

14. The tool of claim 1, wherein the striker forward travel is limited to 0.04 inches when the tip of the striker is even with the forward face of the window breaking tool, the striker is ⅛ inches in diameter and has a pointed tip, the pointed tip having a half angle between 30 and 45 degree.

15. The tool of claim 1, wherein the striker housing chamber is closed for all position of the striker piston, while the blank cartridge resides in the blank cartridge position.

16. A window breaking tool, comprising:

a striker piston housing;

a firing pin piston housing extending back from the striker piston housing;

a striker piston sliding in the striker piston housing;

a striker extending forward from the striker piston, the striker having a pointed tip, the pointed tip having a half angle between 30 and 45 degree;

a striker piston stop limiting forward travel of the striker piston to be between 0.04 and 0.1 inches of travel by contact of a forward facing step of the striker piston with a striker stop surface when the pointed tip of the striker is even with a forward face of the window breaking tool;

a blank cartridge stop configured to position a blank cartridge facing the striker piston and residing between the striker piston housing and the firing pin piston housing;

a striker housing chamber between the blank cartridge stop and the striker piston, the striker housing closed by positioning the blank cartridge in the blank cartridge position, the striker housing chamber having a volume between 0.16 cubic inches and 0.04 cubic inches when closed;

a firing pin piston sliding in the firing pin piston housing;

a fixed firing pin on a forward face of the firing pin piston aligned to fire the blank cartridge to create pressure in the striker housing chamber to propel the striker piston carrying the striker forward;

a trigger attached to the firing pin piston and extending out through the firing pin piston housing to pull the firing pin piston rearward away from the blank cartridge position; and a spring applying forward force against the firing pin piston towards the blank cartridge position.

17. The tool of claim 16, wherein the striker forward travel is limited to 0.04 inches when the tip of the striker is even with the forward face of the window breaking tool, and the striker is ⅛ inches in diameter.

18. The tool of claim 16, wherein the striker housing chamber is closed for all position of the striker piston, while the blank cartridge resides in the blank cartridge position.

19. A window breaking tool, comprising:

a striker piston housing;

a firing pin piston housing extending back from the striker piston housing;

a striker piston sliding in the striker piston housing;

a striker extending forward from the striker piston, the striker having a pointed tip;

a striker piston stop limiting forward travel of the striker piston to not more than 0.06 inches of travel by contact of a forward facing step of the striker piston with a striker stop surface, when the pointed tip of the striker is even with a forward face of the window breaking tool;

a blank cartridge stop configured to position a blank cartridge in a blank cartridge position facing the striker piston and residing between the striker piston housing and the firing pin piston housing;

a striker housing chamber between the blank cartridge stop and the striker piston, the striker housing closed by positioning the blank cartridge in the blank cartridge position, the striker housing chamber having a volume between 0.16 cubic inches and 0.04 cubic inches when closed;

a firing pin piston sliding in the firing pin piston housing;

a fixed firing pin on a forward face of the firing pin piston aligned to fire the blank cartridge to create pressure in the striker housing chamber to propel the striker piston carrying the striker forward;

a trigger attached to the firing pin piston to pull the firing pin piston rearward away from the blank cartridge position;

the trigger reaching out of the firing pin housing through a 0.9 inch long longitudinal slot in the firing pin piston housing, the slot including a recess at an end of the slot farthest from the blank cartridge position, the recess extending angularly around the firing pin piston housing and axially towards the blank cartridge position providing a cocked position for the trigger; and a spring having a free length of two inches and a spring rate of 8 pounds per inch and applying forward force against the firing pin piston towards the blank cartridge position.

20. The tool of claim 19, wherein the striker housing chamber is closed for all position of the striker piston, while the blank cartridge resides in the blank cartridge position.

* * * * *